US007017310B2

(12) United States Patent
Brunt

(10) Patent No.: US 7,017,310 B2
(45) Date of Patent: Mar. 28, 2006

(54) SPACER BAR RETAINERS AND METHODS FOR RETAINING SPACER BARS IN METAL WALL STUDS

(75) Inventor: James Wilson Brunt, Highland, IN (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 10/383,047

(22) Filed: Mar. 6, 2003

(65) Prior Publication Data

US 2004/0172912 A1 Sep. 9, 2004

(51) Int. Cl.
*E04C 2/52* (2006.01)

(52) U.S. Cl. ..... 52/220.1; 52/745.09; 52/736.2; 174/66

(58) Field of Classification Search ..... 52/736.2, 52/733.2, 731.9, 100, 98, 745.09, 220.1, 52/739.1; 174/48, 66, 67; 285/64; 248/73, 248/222.13, 228.7, 231.9; 220/323
See application file for complete search history.

(56) References Cited

U.S. PATENT DOCUMENTS

| | | | | |
|---|---|---|---|---|
| 839,723 | A | 12/1906 | Bury | |
| 894,711 | A | 7/1908 | Worcester | |
| 992,941 | A | 5/1911 | Danielson | |
| 1,101,745 | A | 6/1914 | Jones | |
| 1,346,426 | A | 7/1920 | Scherbner | |
| 1,475,367 | A | 11/1923 | Holmes | |
| 1,603,678 | A | 10/1926 | Furey | |
| 1,656,741 | A | 1/1928 | Lane | |
| 1,791,197 | A | 2/1931 | Dickson | |
| 2,245,908 | A | 7/1941 | Drake | |
| 2,430,654 | A | 11/1947 | Voege | |
| 2,497,827 | A * | 2/1950 | Trafton | 220/787 |
| 2,918,995 | A | 12/1959 | Kruger | |
| 3,010,162 | A | 11/1961 | Klein | |
| 3,201,874 | A | 8/1965 | Christy | |
| 3,305,981 | A | 2/1967 | Biggs et al. | |
| 3,322,447 | A | 5/1967 | Biggs | |
| 3,374,591 | A | 3/1968 | Tillisch et al. | |
| 3,482,369 | A | 12/1969 | Burke | |
| 3,562,970 | A | 2/1971 | Schwartz | |
| 3,653,172 | A | 4/1972 | Schwartz | |
| 3,755,988 | A | 9/1973 | Van Der Sluys | |
| 4,018,020 | A | 4/1977 | Sauer et al. | |

(Continued)

FOREIGN PATENT DOCUMENTS

AU 428738 B 10/1972

(Continued)

OTHER PUBLICATIONS

U.S. Appl. No. 10/641,062, unpublished, Elderson.

(Continued)

*Primary Examiner*—Naoko Slack
(74) *Attorney, Agent, or Firm*—Kirkpatrick & Lockhart Nicholson Graham LLP

(57) ABSTRACT

A retainer and methods for retaining a spacer bar within an opening in a web of a metal stud. In one embodiment, the retainer includes a cover plate that has a plurality of resilient snap members for retaining engagement with the web of the metal stud when the cover plate is pressed into the web opening. The cover plate may have a notch that is configured to nestingly receive a portion of the spacer bar therein. Other embodiments may include retainer tabs for retaining and/or applying a biasing force to the spacer bar.

43 Claims, 8 Drawing Sheets

U.S. PATENT DOCUMENTS 4,031,594 A 6/1977 Cepuritis
4,036,307 A 7/1977 Marais
4,043,689 A 8/1977 Spencer et al.
4,075,810 A 2/1978 Zakrzewski et al.
4,128,979 A 12/1978 Price
4,208,851 A 6/1980 Sauer
4,225,265 A 9/1980 Hooker et al.
4,235,054 A 11/1980 Cable et al.
4,246,736 A 1/1981 Kovar et al.
4,426,822 A 1/1984 Gailey
4,448,004 A 5/1984 Thorsell
4,522,009 A 6/1985 Fingerson
4,604,845 A 8/1986 Brinker
4,625,415 A 12/1986 Diamontis
4,693,047 A 9/1987 Menchetti
4,727,704 A 3/1988 Carlton
4,791,766 A 12/1988 Egri, II
4,809,476 A 3/1989 Satchell
4,840,005 A 6/1989 Cochrane
4,850,169 A 7/1989 Burkstrand et al.
4,858,407 A 8/1989 Smolik
4,860,791 A 8/1989 Putnam
4,914,878 A 4/1990 Tamaki et al.
5,127,760 A 7/1992 Brady
5,155,962 A 10/1992 Burkstrand et al.
5,197,247 A 3/1993 Elderson
5,274,973 A 1/1994 Liang
5,287,664 A * 2/1994 Schiller et al. ..... 52/220.1
5,325,651 A 7/1994 Meyer et al.
5,488,198 A 1/1996 Kramer
5,519,977 A 5/1996 Callahan et al.
5,605,024 A 2/1997 Sucato et al.
5,720,138 A 2/1998 Johnson
5,728,973 A * 3/1998 Jorgensen ..... 174/65 R
5,784,850 A 7/1998 Elderson
5,822,942 A 10/1998 Lucia, Jr.
5,870,874 A 2/1999 Brothers
5,899,041 A 5/1999 Durin
5,904,023 A * 5/1999 diGirolamo et al. ..... 52/712
5,964,071 A * 10/1999 Sato ..... 52/656.1
6,021,618 A 2/2000 Elderson
6,164,028 A 12/2000 Hughes
6,199,336 B1 3/2001 Poliquin
6,241,199 B1 6/2001 Ismert
6,301,854 B1 10/2001 Daudet et al.
6,463,712 B1 10/2002 Kolanko et al.
6,578,335 B1 6/2003 Poliquin
6,616,005 B1 * 9/2003 Pereira et al. ..... 220/241
6,662,520 B1 12/2003 Nelson
6,694,695 B1 2/2004 Collins et al.
6,701,689 B1 3/2004 DiGirolamo
6,702,270 B1 3/2004 Reschke
6,708,460 B1 3/2004 Elderson
6,739,562 B1 5/2004 Rice
2002/0059773 A1 * 5/2002 Elderson ..... 52/667
2003/0037494 A1 2/2003 Collins et al.
2003/0089053 A1 5/2003 Elderson
2003/0106280 A1 6/2003 diGirolamo
2003/0145537 A1 8/2003 Bailey
2003/0167722 A1 9/2003 Klein et al.

FOREIGN PATENT DOCUMENTS

GB 593443 A 10/1947
GB 2103264 A 2/1983
WO WO 93/24712 A 12/1993
WO WO 96/23945 A 8/1996
WO PCT/US00/11991 11/2000

OTHER PUBLICATIONS

"Don't Just Space it, BRACE-IT", brochure, publication date unknown, TRUSTWAL Systems, Arlington, Texas.
"Products That Meet the New A.D.A. Code Flush Mount and Notch Tite and OTher Products: Fire Blocking, Bridging, SLP-TRK and Specialty Items", 1994, Metal Lite, Inc., Anaheim, CA.
American Iron and Steel Institute, Low-Rise Residential Construction Details, Publication RG-934, Jun. 1993, p. F.12, Washington, DC.
US Department of Housing and Urban Development, Prescriptive Method for Residential Cold-Formed Steel framing Second Edition, Sep. 1997, pp. 16 and 17, Upper Marlboro, MD.
Zinc Institute Incorporated, Residential Steel Frame Construction, 1982, p. 3A.26, New York, New York.
Unimast Incorporated, Steel Framing Systems Technical Information, 1991, p. 12, Franklin Park, IL.
Marino Industries Corporation, STUD-RITE Lightweight Steel Framing, 1982, Westbury, New York.

* cited by examiner

SPACER BAR RETAINERS AND METHODS FOR RETAINING SPACER BARS IN METAL WALL STUDS

BACKGROUND OF THE INVENTION

1. Field of the Invention

The invention relates to walls constructed from metal studs and, more particularly, to apparatuses and methods for retaining spacer/stiffening bars that extend through openings in metal wall studs.

2. Description of the Invention Background

Traditionally, the material of choice for new residential and commercial building framing construction has been wood. However, over the years, the rising costs of lumber and labor required to install wood framing components have placed the dream of owning a newly constructed home out of the economic reach of many families. Likewise such increasing costs have contributed to the slowing of the development and advancement of urban renewal plans in many cities. Other problems such as the susceptibility to fire and insect damage, rotting, etc. are commonly associated with wood building products.

In recent years, in an effort to address such problems, various alternative building materials and construction methods have been developed. For example, a variety of metal stud and frame arrangements have been developed for use in residential and/or commercial structures. Such studs are traditionally C-shaped with a planar web portion and a pair of legs that protrude therefrom. To facilitate the passage of utility members such as wires, pipes, etc. through the studs and to facilitate bracing of the studs, the stud webs generally have a series of openings punched therein. Unfortunately, if the utility member that passes through the opening is un-insulated and fabricated from a metal that is dissimilar from the metal from which the stud is made, a galvanic reaction could be caused between the utility member and the stud resulting corrosion and deterioration of the utility member and the stud. Further, it is possible that the edges of the openings in the stud webs could be jagged and rough which might lead to damage of the utility members or injury to the installer.

Ordinarily, such metal studs, when arranged in conventional vertical relationship, are braced by traverse spacer bars that extend through vertically spaced openings in the webs of the metal studs. Some spacer bars, such as those disclosed in PCT Application No. PCT/US96/01522 and Australian Published Patent Specification No. 30,388, are configured to fit into a complimentary-shaped opening in the stud webs. PCT Application No. PCT/AU93/00246 discloses a spacer bar that appears to have grooves cut therein that permits the bar to be seated into each respective stud opening. However, spacer bars of the types described above may become inadvertently jarred or otherwise moved out of retaining engagement with the studs as the wall construction continues. In an effort to prevent that from happening, spacer bars that are designed to bite into or retainingly engage the stud webs were designed. U.S. Pat. Nos. 5,784,850 and 6,021,618 to Elderson disclose spacer bars that are designed to retainingly engage the stud webs.

At times, however, even with the types of spacer bars described above, it may be desirable to use additional means to secure the bar to the studs. The additional means ensure that the strength and stiffness of the bridging system is maximized. Thus, brackets have been developed to retain the spacer bars in position. U.S. Pat. No. 3,322,447 to Biggs and U.S. Pat. No. 5,904,023 to diGirolamo et al. disclose various types of clips and brackets that are attached to the studs to retain various types of spacer bars in position. Such clips are usually either attached to the spacer bars and/or the webs of the studs by conventional fastening means such as welding or metal screws and thus, can led to increased installation costs.

SUMMARY

One embodiment of the invention provides a retainer for retaining a spacer bar within an opening in a web of a metal stud. The retainer may include a cover plate that has a plurality of resilient snap members for retaining engagement with a portion of the web of the metal stud that extends around the stud opening. The cover plate may also include at least one retainer tab that is oriented adjacent to the spacer bar when the cover plate is affixed to the stud by the plurality of resilient snap retainers which extend into the web opening.

Another embodiment of the present invention comprises a wall that includes at least two metal studs that each have a web portion with at least one web opening therethrough. A spacer bar extends through the web openings of at least two of the metal studs and engages the web portions thereof adjacent to an end of each web opening to space the at least two metal studs apart from each other a predetermined distance. At least one retainer member corresponding to at least one of the web openings through which the spacer bar extends is snapped into the web opening to retain the spacer bar therein.

Another embodiment of the present invention includes a method for constructing a wall which includes supporting a first metal stud having a web with at least one opening therethrough in a vertical orientation such that the first metal stud is plumb. The method also includes supporting a plurality of additional metal studs that each have a web and at least one web opening therethrough such that the web openings of the additional metal studs are aligned with the web openings in the first metal stud. At least one spacer bar is inserted through the aligned web openings of the first metal stud and additional metal studs to orient the first metal stud and the additional metal studs at desired spacing intervals relative to each other. Corresponding retainer members are snapped into the web openings of the first metal stud and additional metal studs such that the spacer bars are retained in each respective web opening.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
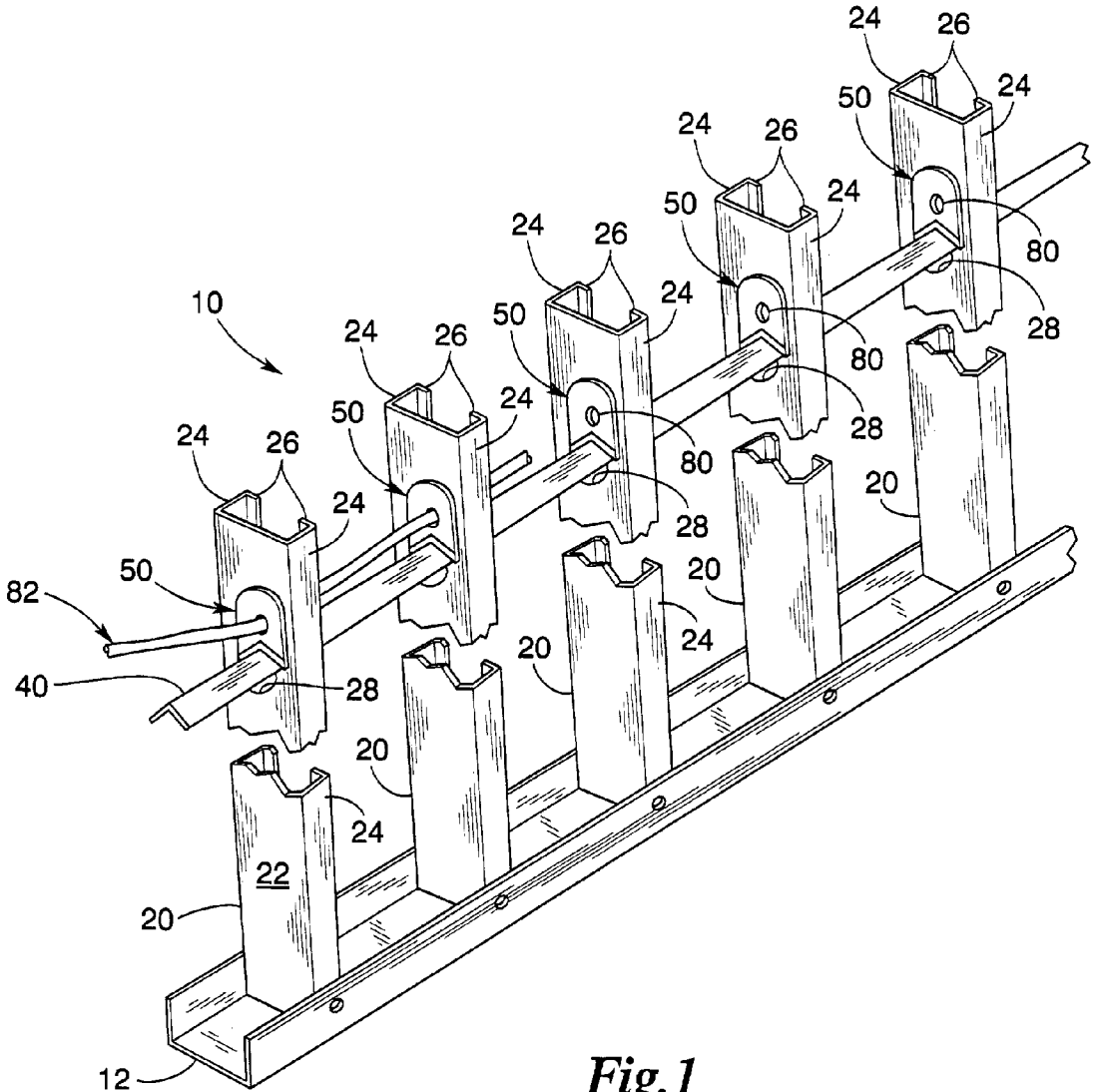
FIG. 1 is a partial perspective view of a metal stud wall employing one embodiment of the spacer bar retainers of the present invention.

Referring now to the drawings for the purpose of illustrating the invention and not for the purpose of limiting the same, it is to be understood that standard components or features that are within the purview of an artisan of ordinary skill and do not contribute to the understanding of the various embodiments of the invention are omitted from the drawings to enhance clarity.

FIG. 1 is a partial perspective view of a metal stud wall 10 employing one embodiment of the spacer bar retainers 50 of the subject invention. As can be seen in that Figure, the metal stud wall 10 commonly includes a C-shaped metal base member 12 and a plurality of C-shaped metal studs 20 that extend vertically from the base member and that are attached to the base member 12 by conventional fasteners such as sheet metal screws, rivets, etc. Those of ordinary skill in the art will understand that the top portions of the studs 20 may also be attached to a C-shaped metal top plate (not shown) in a similar manner. The base member 12 is commonly secured to the floor or other support structure and the top plate is secured to the rafters or roof structure.

The C-shaped metal studs 20 are typically fabricated from galvanized steel or similar material and have a web portion 22 and two leg portions 24. Each leg portion 24 may also have a lip or return 26 thereon. To facilitate passage of utility members, such as wires, conduit pipe, etc. through the wall 10, each stud 20 is provided with one or more openings 28 through its web portion. The openings 28 may be shaped as shown in the Figures (i.e., an elongated slot with a rounded upper end 30 and a rounded lower end 32). The openings 28 each have a perimeter, generally designated as 34. Depending upon the application and particular stud configuration employed, the openings 28 may have different shapes. As the present Detailed Description proceeds, however, those of ordinary skill in the art will appreciate that the various embodiments of the retainers of the present invention may be constructed for use in connection with a variety of differently shaped stud openings. Thus, the various embodiments of the retainers of the present invention should not be limited to use with studs having the particular openings depicted in the present Figures.

To facilitate spacing and support of the metal studs 20 at desired intervals, spacer bars 40 may be employed. A variety of spacer bars are known, such as those depicted in U.S. Pat. Nos. 5,784,850 and 6,021,618, the disclosures of which are herein incorporated by reference. The spacer bars 40 may be provided with notches 42, or grooves, slots, tabs, etc. for engagement with a portion of the stud web 22. The notches 42 may be spaced at desired intervals such that when the spacer bar 40 is inserted through the stud openings 28, a portion of the stud web 22 adjacent the bottom end 32 of the opening 28 may be received in the notches 42. In some spacer bars 40, the notches 42 are designed to "bite" into or otherwise retainingly engage the stud web 22. Such spacer bars 40 may be installed by tapping the spacer bar 40 with a hammer or other hand tool to cause it to move down onto and engage a portion of the stud web 22. In this manner, the spacer bar 40 establishes the spacing of the studs 20 and provides lateral support to each of the studs 20 to prevent unwanted bowing or twisting of the studs 20. As will be appreciated, only one stud 20 needs to be plumbed. Thus, after a "first" stud 20 has been plumbed and fixed in place, all other studs 20 should be held plumb by the spacer bar 40 or chain of overlapping spacer bars 40.

Other forms and types of spacer bars may employ vertical slots that are sized to receive the stud web therein without establishing an interference fit between the spacer bar and the stud web. Yet other spacer bar arrangements may be provided with tabs that engage the stud web or have irregularly shaped slots that engage the webs of the studs. Those of ordinary skill in the art will appreciate that various embodiments of the retainer of the subject invention may be configured to work equally well with a variety of different types and shapes of spacer bars. For example, the spacer bar may be U-shaped or arcuate in shape, etc.

Figure 4:
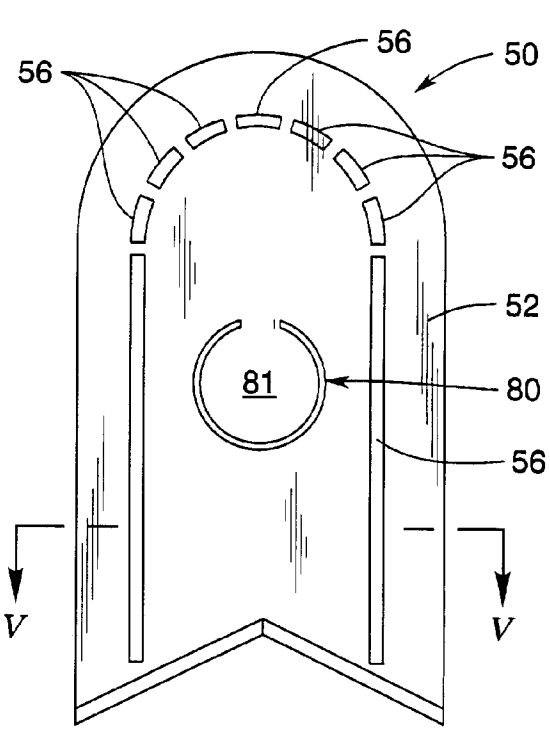
FIG. 4 is a rear view of the retainer depicted in FIGS. 2 and 3.
Figure 5:
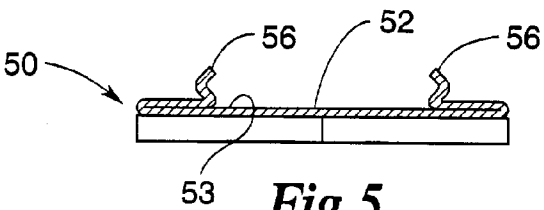
FIG. 5 is a cross-sectional view of the retainer of FIG. 4 taken along line V—V in FIG. 4.
Figure 6:
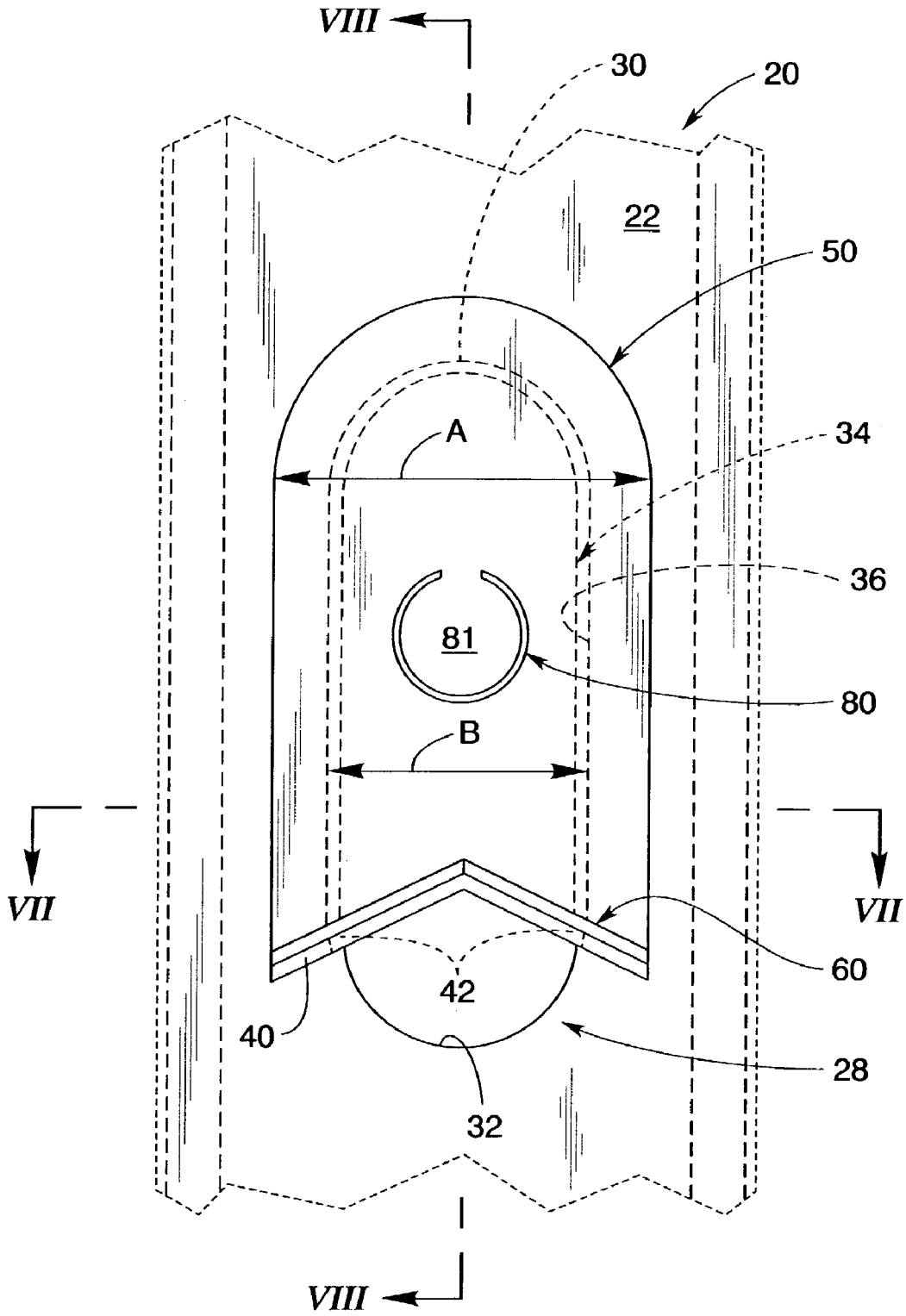
FIG. 6 is a front view of a retainer of the type depicted in FIGS. 2–5 installed in an opening in a metal stud.

FIGS. 2–6 illustrate one embodiment of a spacer bar retainer 50 of the present invention. As can be seen in those Figures, the retainer 50 includes a cover plate 52 that may be sized to completely cover the portion of the opening 28 in the web 22 that is located above the spacer bar 40 after the spacer bar 40 has been seated or otherwise placed into the lower end 32 of the opening 28. In FIG. 6, the portion of the web opening 28 extending above the spacer bar 40 has been generally designated as 36. In this embodiment, the retainer 50 is fabricated from high tensile strength steel plate. For example, high tensile steel plate that is 1/32" or 1/16" thick may be employed. It is conceivable, however, that the retainer 50 may be fabricated from other types and thicknesses of metals or "polymeric" materials such as plastic, polyvinyl chloride, etc. The retainer 50 could also be fabricated from rubber or rubber-like material.

In the embodiment depicted in FIGS. 2–5, the cover plate 52 is sized to be wider than the width of the opening 28 in the stud web 22. For example, the width "A" of the cover plate 52 may be 2 inches for applications wherein the stud opening 28 is 1.5 inches wide (width "B" in Figure). However, the cover plate 52 may be provided with other widths and sizes relative to the width and size of the opening 28 without departing from the spirit and scope of the present invention.

Figure 3:
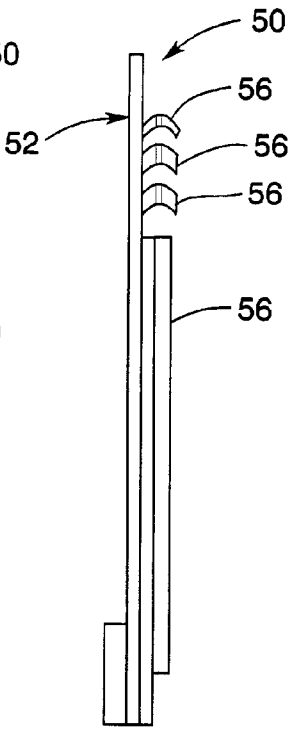
FIG. 3 is a left side view of the retainer of FIG. 2.
Figure 2:
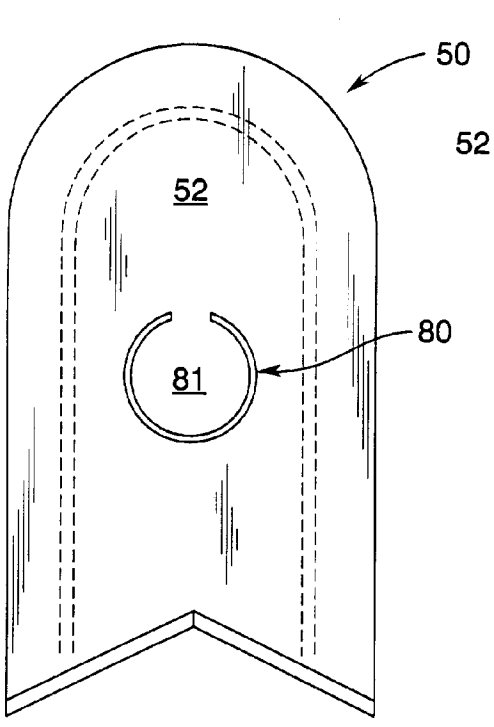
FIG. 2 is a front view of a retainer embodiment of the present invention.
Figure 8:
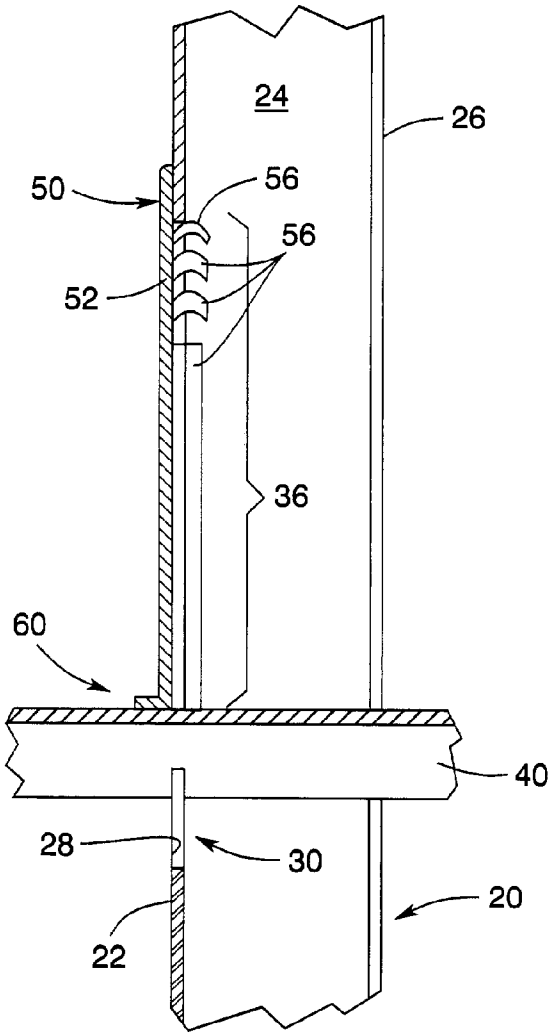
FIG. 8 is a cross-sectional view of the retainer and stud depicted in FIG. 6 taken along line VIII—VIII in FIG. 6.
Figure 7:
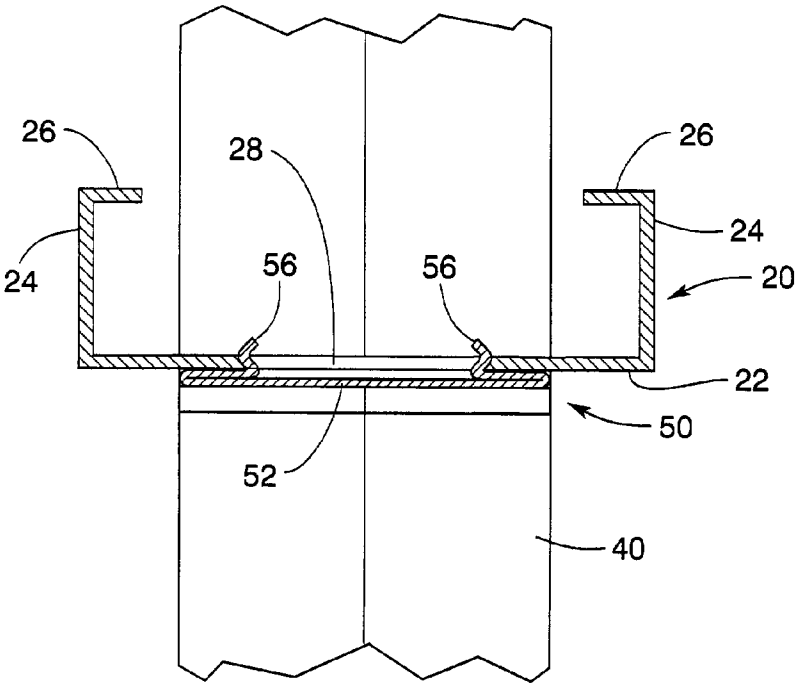
FIG. 7 is a cross-sectional view of the retainer and stud depicted in FIG. 6 taken along linne VII—VII in FIG. 6.

Also in this embodiment, the edges of the metal cover plate 52 may be folded over the rear side 53 of the cover plate 52 and a plurality of resilient snap clips 56 may be cut and bent into the metal as shown in FIGS. 3–5. In this embodiment, the snap clips 56 are shaped to permit the cover plate 52 to be positioned in front of the opening 28 in the stud web 22 and then pressed or otherwise forced into snapping engagement with the stud web 22. It will be appreciated that the resilient snap clips 56 initially flex to enable the stud web 22 to be received between the cover plate 52 and outer edges of the snap clips 56 as shown in FIGS. 7 and 8. Those of ordinary skill in the art will appreciate that the amount of retention force generated by the resilient snap clips 56 and the amount of force necessary to snap the retainer 50 into the opening 28 can be dependent upon the type of materials used and the dimensions and configurations of the snap clips 56. While the snap clips 56 described above are integrally formed within the cover plate 52, those of ordinary skill in the art will appreciate that other forms of snap retainers could conceivably be attached to the cover plate to snappingly affix the retainer to the stud web 22 without departing from the spirit and scope of the present invention. For example, spring biased retention members, detents, etc. could be used to snappingly affix the retainer to the stud.

Also in this embodiment, a retaining tab assembly 60 or biasing assembly may be formed on the lower end of the cover plate 52. The retaining tab assembly 60 may comprise a pair of retainer tabs 62 cut into the lower portion of the cover plate 52 and bent to define a notch 70 that has a contour that substantially matches the cross-sectional shape or outer contour of a spacer bar 40. For example, in the embodiment depicted in FIGS. 6 and 7, the spacer bar 40 has a V-shaped cross-section and the notch 70 has the shape of an inverted "V" so that when the retainer 50 is snappingly attached to a portion of the web 22 defining the web opening 28 as described above, the spacer bar 40 is "nestingly" received within the notch 70. In one embodiment, the retainer tabs 62 may be bent to bias the spacer bar 40 into engagement with the stud web 22 when the retainer 50 is snapped into the installed position as shown in FIG. 6. It will also be appreciated that the notch 70 can be sized and shaped to accommodate overlapped spacer bars 40 in the manner illustrated in FIG. 1.

For those embodiments wherein the retainer 50 is molded or otherwise fabricated from polymeric materials or rubber, the retaining tab assembly 60 may also be molded to establish a biasing force against the spacer bar 40 when the retainer 50 is installed or the retainer tab assembly 60 may be molded to act as a stop to prevent the spacer bar 40 from being dislodged from the stud 20 without applying a biasing force to the spacer bar 40. Another advantage enjoyed by this embodiment of the present invention is the ability to center the spacer bar 40 within the bottom portion 32 of the web opening 28. That is, by centrally positioning the notch 70 in the lower end of the cover plate 52, the notch may serve to center the spacer bar 40 when the retainer 50 is snapped into the web opening 28.

To facilitate passage of utility members 82 such as wires, conduit, piping, etc. through the stud openings 28 and the retainers 50, the retainers 50 may be provided with one or more utility openings 80 therein. If desired, a knockout slug 81 may be provided in the cover plate such that the user may easily remove the knockout slug 81 if an opening 80 is required. Such knockout slug 81 can be of the type commonly employed in electrical junction boxes and the like.

Figure 9:
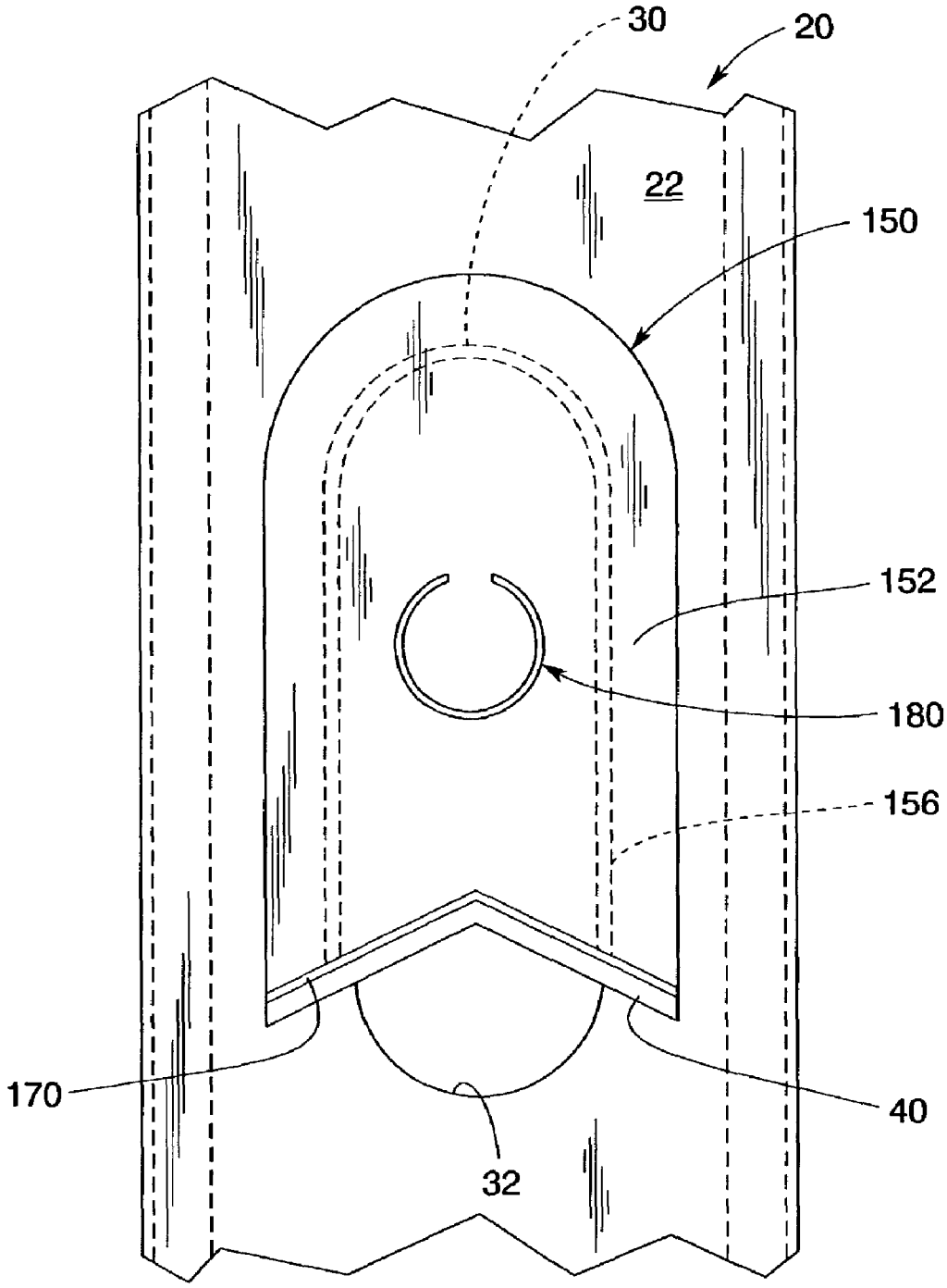
FIG. 9 is front view of another retainer embodiment of the present invention installed in an opening in a metal stud.

Another embodiment of a retainer 150 of the present invention is depicted in FIG. 9. In this embodiment, the retainer 150 is identical to the retainer 50 described above, except that it lacks the retaining tab assembly 60. A notch 170 is provided in the bottom portion of the cover plate 152 for nestingly receiving the spacer bar 40 or spacer bars (when overlapped) therein. The reader will appreciate that the cover plate 152 has the above-mentioned resilient snap clips 56 formed thereon. Also, a knockout slug 181 may be provided in opening 180 in the cover plate 152 to facilitate passage and support of utility members through the retainers 150.

Figure 10:
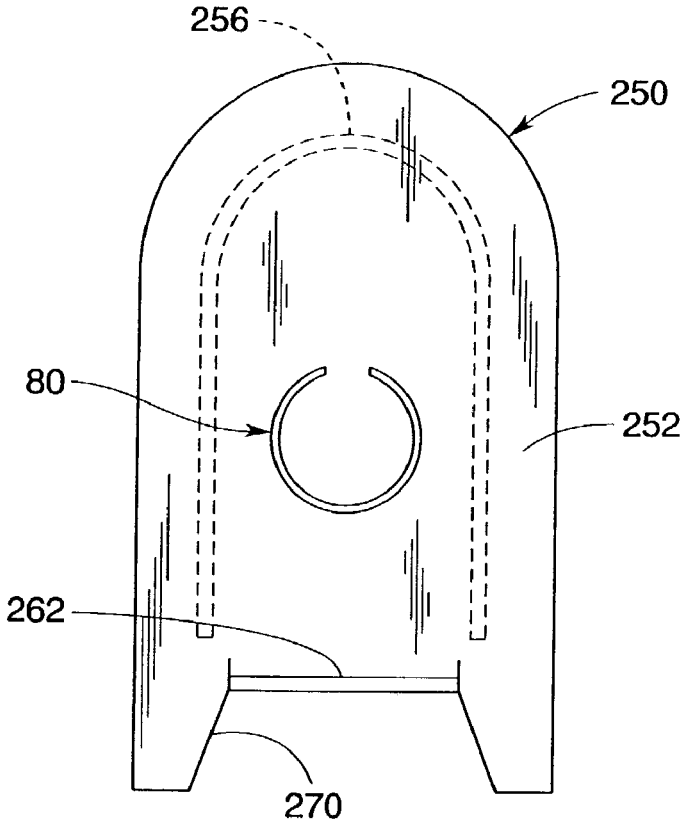
FIG. 10 is a front view of another retainer embodiment of the present invention.
Figure 11:
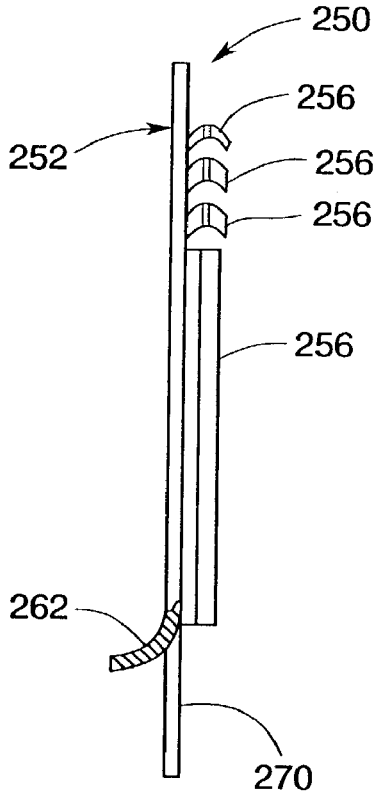
FIG. 11 is a left side elevation view of the retainer of FIG. 10 with a portion thereof shown cross-section for clarity.
Figure 12:
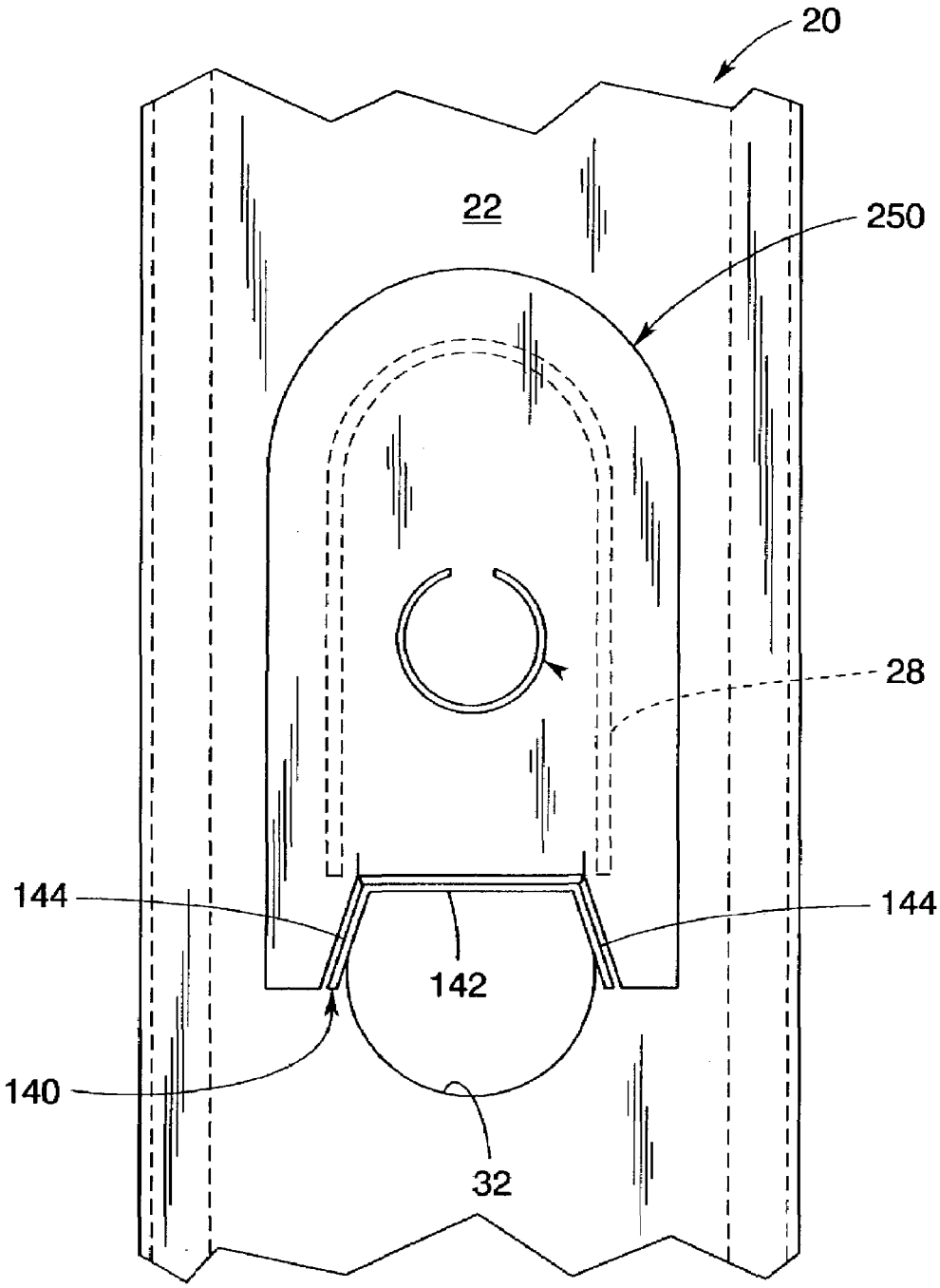
FIG. 12 is a front view of a retainer of the type depicted in FIGS. 10 and 11 in stalled in an opening in a metal stud.

As indicated above, the unique and novel aspects of the present invention are not limited to a particular shaped opening in the stud webs or a particular shape of spacer bar. For example, FIGS. 10–12 depict another retainer embodiment of the present invention for use in connection with a spacer bar 140 that is roughly U-shaped. The spacer bar 140 in this embodiment has a relatively planar upper portion 142 and two leg portions 144 that each protrude from the planar upper portion 142 at an angle. Slots or notches (not shown) sized to receive and engage the stud web 22 therein are provided in the leg portions at desired intervals. If desired, stiffener ribs may be provided in the planar upper portion 142 and/or the leg portions 144 for additional strength and rigidity.

Figure 13:
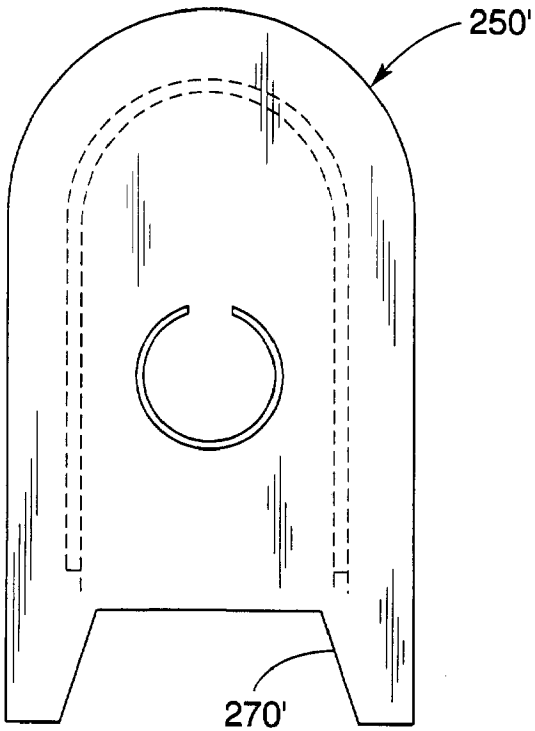
FIG. 13 is front view of another retainer embodiment of the present invention.

The retainer 250 in this embodiment has a cover plate 252 of the type and construction described above and at least one resilient snap clip 256 of the types and construction described above attached to or integrally formed thereon. The lower end of the cover plate 252 has a notch 270 therein that is configured to nestingly receive the U-shaped spacer bar 140 therein. If desired, the retainer 250 may be provided with one or more retainer tabs 262 or biasing members for biasing the U-shaped spacer bar 140 into engagement with the stud web 22. In an alternative embodiment, the retainer 250' includes the notch 270' without the retainer tab. See FIG. 13. The retainers 250, 250' of these embodiments may be installed in stud web openings 28 in the manners described above.

Figure 14:
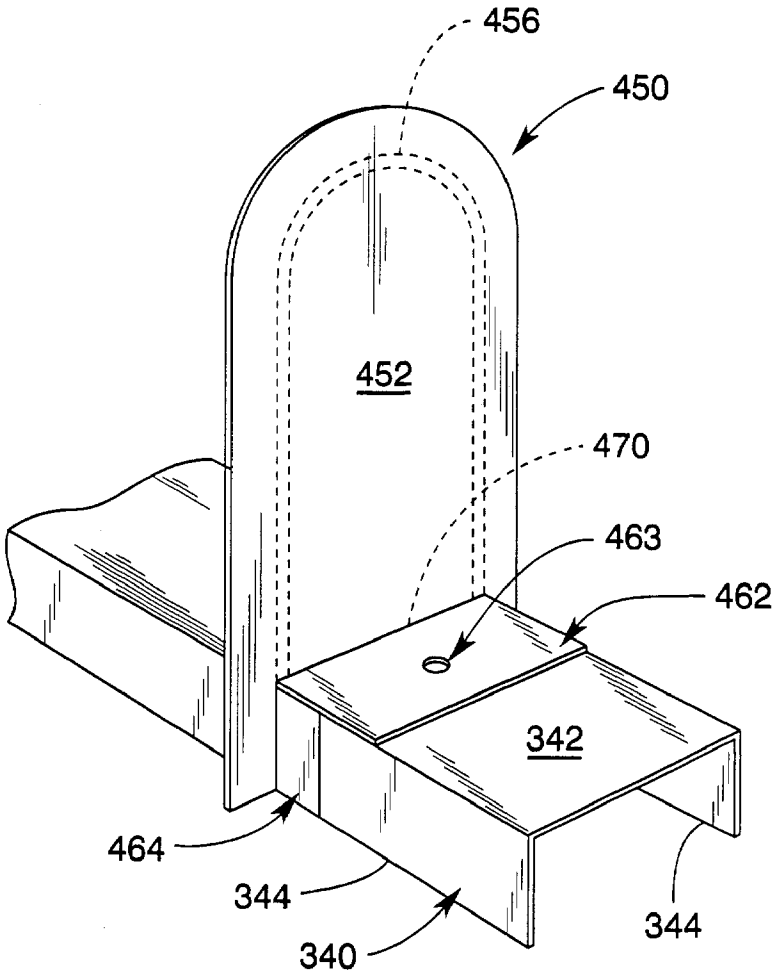
FIG. 14 is a partial perspective view of another retainer embodiment of the present invention supporting a U-shaped bar with the stud omitted for clarity.

FIG. 14 depicts another retainer embodiment of the present invention for use in connection with a spacer bar 340 that is U-shaped. The spacer bar 340 in this embodiment has a relatively planar upper portion 342 and two leg portions 344 that each protrude from the planar upper portion 342. Slots or notches (not shown) may be provided in the leg portions 344 at desired intervals for receiving a portion of a web of a corresponding stud (not shown) therein. Other spacer bar embodiments may not be provided with such notches.

The retainer 450 in this embodiment has a cover plate 452 of the type and construction described above and at least one resilient snap clip 456 of the types and construction described above attached to or integrally formed thereon. The lower end of the cover plate 452 has a notch 470 therein that is configured to nestingly receive the U-shaped spacer bar 340 therein. If desired, the retainer 450 may be provided with a retainer tab 462 which corresponds to the planar portion 342 of the spacer bar 340. The retainer tab 462 may have at least one hole 463 therethrough to receive a fastener such as a screw or the like to attach the retainer tab 462 to the upper planar portion of the spacer bar 340. It will be appreciated that such arrangement prevents those spacer bars that lack the slots or notches for engaging the stud webs from sliding within the stud opening. In addition, the cover plate 452 may have at least one and preferably two lateral retainer tabs 464 which each correspond to one of the leg portions 344 of the spacer bar 340 as shown in FIG. 14. Such lateral retainer tabs 464 prevent the spacer bar 340 from rotating within the stud opening. If desired, one or both of the lateral retainer tabs 464 may also be attached to the corresponding leg portions of the spacer bar 340.

The various embodiments of the present invention described above-offer vast improvements over the apparatus and methods commonly employed when constructing metal walls. In particular, in the past, after the spacer bars were installed, brackets had to be screwed into the studs and often into the spacer bars which required additional labor and time to install. The retainers of the present invention are designed to be retained in place without the use of additional mechanical fasteners or fastening methods. For example, various retainer embodiments of the present invention may be snapped into place by the installer immediately after the spacer bars have been installed. There is no need for power drills, screwdrivers or the like to complete the installation.

In addition to the above-mentioned advantages, various retainer embodiments of the present invention may also act as grommets for supporting and protecting the utility members that pass through the openings in the studs. In particular, if the openings in stud webs inadvertently have ragged edges, such ragged edges could damage the utility members extending therethrough and/or injure the installer during insertion of the utility members through the openings. Furthermore, by acting as a grommet, the retainer can prevent the likelihood of galvanic corrosion occurring between utility members and a stud that are fabricated from dissimilar materials. Also, various embodiments of the subject invention may be provided with smooth openings in the retainer cover plate that are sized and shaped to accommodate a particular utility member.

Yet another advantage provided by the subject invention concerns reinforcement of the openings in the studs. In those embodiments wherein the cover plate completely covers the opening extending above the spacer bar, the retainer will act to reinforce the opening which results in a stronger wall construction.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit invention. The preceding description, therefore, is not meant to limit the scope of the invention. Rather the scope of the invention is to be determined only by the appended claims and their equivalents.

What is claimed is:

1. A stud spacer retainer system for use with metal studs that each have a web with at least one opening therethrough, said system comprising:

a spacer bar sized to extend through the openings in the webs of at least two metal studs that are spaced at a desired distance from each other;

a cover plate;

a plurality of nonplanar resilient snap members on said cover plate for retaining engagement with a portion of the web of one of the metal studs defining the opening, such that no portion of said cover plate extends below the opening in the web of the stud; and at least one retainer tab protruding from said cover plate oriented adjacent to the spacer bar when said cover plate is retained in the web opening by said plurality of resilient snap retainers.

2. The stud spacer retainer system of claim 1 wherein said retainer tab is integrally formed with said cover plate.

3. The stud spacer retainer system of claim 1 wherein said at least one retainer tab applies a biasing force to the spacer bar when said cover plate is in said retaining engagement with the web of the metal stud.

4. The stud spacer retainer system of claim 2 wherein said plurality of resilient snap retainers are integrally formed with said cover plate.

5. The stud spacer retainer system of claim 1 wherein a portion of said cover plate spans across a portion of the opening in the stud web when said cover plate is pressed into the opening and wherein said portion of said cover plate has at least one opening therethrough.

6. The stud spacer retainer system of claim 1 wherein said cover plate has at least one knockout formed therein.

7. The stud spacer retainer system of claim 1 wherein the web opening has a web opening width and wherein said cover plate has a cover plate width that is greater than said web opening width.

8. The stud spacer retainer system of claim 1 wherein said cover plate and said at least one retaining tab are fabricated from a material selected from a group of materials consisting of metal, polymeric materials and rubber.

9. The stud spacer retainer system of claim 1 wherein a shape of said retainer tab is complementary to a cross-sectional shape of the spacer bar.

10. The stud spacer retainer system of claim 1 wherein said retainer tab has an inverted V shape.

11. A stud spacer retainer system for use with metal studs that each have a web with at least one opening therethrough, said system comprising:

a spacer bar sized to extend through the openings in the webs of at least two metal studs that are spaced at a desired distance from each other;

a cover plate having a notch therein that matches a cross-sectional shape of the spacer bar; and a plurality of nonplanar resilient snap retainers on said cover plate for retaining engagement with the web of the metal stud when said cover plate is pressed into the web opening such that a portion of the spacer bar is received within said notch and no portion of the cover plate extends below the opening in the web of the stud.

12. The stud spacer retainer system of claim 11 wherein said cover plate is formed from a material selected from the group consisting of sheet metal, polymeric material, and rubber.

13. The stud spacer retainer system of claim 11 wherein said plurality of resilient snap retainers are integrally formed in the cover plate.

14. The stud spacer retainer system of claim 11 further comprising at least one knockout in said cover plate.

15. The stud spacer retainer system of claim 11 wherein the spacer bar has a V-shaped cross-section and wherein said notch in said cover plate has an inverted V-shape.

16. The stud spacer retainer system of claim 11 wherein said notch is so shaped to centrally locate and retain the spacer bar within a bottom portion of the web opening when said cover plate is retained in an upper portion of the web opening by said plurality of resilient snap retainers.

17. A stud spacer retainer system for use with metal studs that each have a web with at least one opening therethrough, said system comprising:

a spacer bar sized to extend through the openings in the webs of at least two metal studs that are spaced at a desired distance from each other;

a cover plate sized to completely cover a portion of the opening in the stud web that extends above the spacer bar;

at least one nonpianar resilient retainer protruding from said cover plate for retaining engagement with a portion of the stud surrounding the opening therein to retain the cover plate in position wherein said cover plate completely covers the portion of the opening in the stud web that extends above the spacer bar and such that no portion of the cover plate extends below the opening in the stud; and a retaining tab protruding from said cover plate and adjacent to said spacer bar when said cover plate is retained in position by said at least one resilient retainer said retaining tab having at least one fastener hole therethrough.

18. The stud spacer retainer system of claim 17 wherein each said at least one resilient retainer is formed from a portion of said cover plate.

19. The stud spacer retainer system of claim 17 further comprising at least one knockout in said cover plate.

20. The stud spacer retainer system of claim 17 wherein said cover plate and said at least one retaining tab are fabricated from a material selected from a group of materials consisting of metal, polymeric materials and rubber.

21. A wall, comprising:

at least two metal studs each said metal stud having a web portion with at least one web opening therethrough;

a spacer bar extending through the web openings of at least two of said metal studs and engaging the web portions thereof adjacent to an end of each said web openings to space said at least two said metal studs apart from each other a predetermined distance; and at least one retainer member corresponding to at least one of said web openings through which said spacer bar extends and having a cover plate with at least one non-planar resilient snap member protruding therefrom for snappingly retaining the cover plate in another end portion of said web opening to retain said spacer bar in engagement with said web portion and such that no portion of the cover plate extends below the web opening.

22. The wall of claim 21 wherein each said retainer member has a retaining tab protruding therefrom for contact with a portion of said spacer bar.

23. The wall of claim 22 wherein at least one said cover plate has at least one knockout therein.

24. The wall of claim 21 wherein each said retainer has a biasing member protruding therefrom to apply a biasing force to said spacer bar.

25. The wall of claim 21 further comprising a retainer tab on each said retainer member wherein each said retainer member has a shape that is complementary to a cross-sectional shape of the spacer bar.

26. The wall of claim 21 wherein each said biasing member is shaped to nestingly receive a portion of said spacer bar therein.

27. The wall of claim 21 wherein each said cover plate has a notch therein that is shaped to nestingly receive a portion of said spacer bar therein.

28. The wall of claim 21 wherein said spacer bar has a V-shaped cross-section and a plurality of notches therein for engaging the webs of the studs.

29. The wall of claim 21 wherein each said retainer is fabricated from material selected from the group of materials consisting of metal, polymeric material, and rubber.

30. A method for constructing a wall, comprising:

supporting a first metal stud having a web with at least one opening therethrough in a vertical orientation such that the first metal stud is plumb;

supporting a plurality of additional metal studs that each have a web and at least one web opening therethrough such that the web openings of the additional metal studs are aligned with the web opening in the first metal stud;

inserting a spacer bar through the aligned web openings of the first metal stud and additional metal studs to orient the first metal stud and the additional metal studs at desired spacing intervals relative to each other; and snapping a corresponding retainer member in the web openings of the first metal stud and additional metal studs such that the spacer bar is retained in each web opening an such that no portion of said corresponding retainer member protrudes below the opening into which it is snapped.

31. The method of claim 30 wherein said supporting a first metal stud comprises:

attaching a base member to a structure; and attaching a bottom end of the first metal stud to the base member such that the first metal stud is supported in a vertical orientation wherein the first metal stud is plumb.

32. The method of claim 30 further comprising attaching a bottom end of each additional metal stud to the base member.

33. The method of claim 30 further comprising inserting at least one utility member through openings in the corresponding retaining members.

34. The method of claim 30 further comprising attaching a portion of at least one retainer member to the spacer bar.

35. A method of retaining a spacer bar extending through an opening in a web of a metal stud in retaining engagement with the web of the metal stud, said method comprising snapping a retainer into the opening in the metal stud such that the retainer applies a biasing force to the spacer bar and such that no portion of the retainer extends below the opening.

36. The method of claim 35 further comprising inserting at least one utility member through an opening in the retainer.

37. A retainer for retaining a spacer bar within an opening in a web of a metal stud, said retainer comprising:

a cover plate having at least one knockout formed therein;

a plurality of resilient snap members on said cover plate for retaining engagement with a portion of the web of the metal stud defining the opening; and at least one retainer tab protruding from said cover plate oriented adjacent to the spacer bar when said cover plate is retained in the web opening by said plurality of resilient snap retainers.

38. A retainer for retaining a spacer bar within an opening in a web of a metal stud, said retainer comprising:

a cover plate having at least one knockout therein and a notch that matches a cross-sectional shape of the spacer bar therein said cover plate; and a plurality of resilient snap retainers on said cover plate for retaining engagement with the web of the metal stud when said cover plate is pressed into the web opening such that a portion of the spacer bar is received within said notch.

39. A wall, comprising:

at least two metal studs each said metal stud having a web portion with at least one web opening therethrough;

a spacer bar extending through the web openings of at least two of said metal studs and engaging the web portions thereof adjacent to an end of each said web openings to space said at least two said metal studs apart from each other a predetermined distance; and at least one retainer member corresponding to at least one of said web openings through which said spacer bar extends and having a cover plate with at least one knock out therein and at least one resilient snap member protruding therefrom for snappingly retaining the cover plate in another end portion of said web opening to retain said spacer bar in engagement with said web portion.

40. A method for constructing a wall, comprising: supporting a first metal stud having a web with at least one opening therethrough in a vertical orientation such that the first metal stud is plumb;

supporting a plurality of additional metal studs that each have a web and at least one web opening therethrough such that the web openings of the additional metal studs are aligned with the web opening in the first metal stud;

inserting a spacer bar through the aligned web openings of the first metal stud and additional metal studs to orient the first metal stud and the additional metal studs at desired spacing intervals relative to each other;

snapping a corresponding retainer member in the web openings of the first metal stud and additional metal studs such that the spacer bar is retained in each web opening; and inserting at least one utility member through an opening in the retainer.

41. A retainer for retaining a spacer bar within an opening in a web of a metal stud, said retainer comprising:

a cover plate;

a plurality of nonplanar resilient snap members on said cover plate for retaining engagement with a portion of the web of the metal stud defining the opening, such that no portion of said cover plate extends below the opening in the web of the stud; and at least one retainer tab protruding from said cover plate oriented adjacent to the spacer bar when said cover plate is retained in the web opening by said plurality of resilient snap retainers, said retainer tab having an inverted V shape.

42. A retainer for retaining a spacer bar having a V-shape shaped cross-section within an opening in a web of a metal stud, said retainer comprising:

a cover plate having a notch therein that has an inverted V-shape that matches a cross-sectional shape of the spacer bar; and a plurality of nonplanar resilient snap retainers on said cover plate for retaining engagement with the web of the metal stud when said cover plate is pressed into the web opening such that a portion of the spacer bar is received within said notch and no portion of the cover plate extends below the opening in the web of the stud.

43. A retainer for retaining a spacer bar within a bottom portion of an opening in a web of a metal stud, said retainer comprising:

a cover plate sized to completely cover a portion of the opening in the stud web that extends above the spacer bar;

at least one nonplanar resilient retainer protruding from said cover plate for retaining engagement with a portion of the stud surrounding the opening therein to retain the cover plate in position wherein said cover plate completely covers the portion of the opening in the stud web that extends above the spacer bar and such that no portion of the cover plate extends below the opening in the stud; and a retaining tab protruding from said cover plate and adjacent to said spacer bar when said cover plate is retained in position by said at least one resilient retainer, said retaining tab having at least one fastener hole therethrough.

* * * * *

UNITED STATES PATENT AND TRADEMARK OFFICE

CERTIFICATE OF CORRECTION

PATENT NO. : 7,017,310 B2
APPLICATION NO. : 10/383047
DATED : March 28, 2006
INVENTOR(S) : James Wilson Brunt It is certified that error appears in the above-identified patent and that said Letters Patent is hereby corrected as shown below:

On the Title Page, under "U.S. PATENT DOCUMENTS", delete "1,475,367 A" should read --1,475,387 A--

On Page 2, under "OTHER PUBLICATIONS", delete ""Don't Just Space it, BRACE-IT', brochure, publication date unknown, TRUSTWAL Systems, Arlington, Texas", should read --"Don't Just Space It, BRACE-IT", brochure, publication date unknown, TRUSWAL Systems, Arlington, Texas--.

On Page 2, under "OTHER PUBLICATIONS", delete "" Products That Meet the New A.D.A. Code Flush Mount and Notch Tite and OTher Products:", should read --Products That Meet the New A.D.A. Code Flush Mount and Notch Tite and Other Products:--

In column 2, line 67, delete "linne" and replace therewith --line--.

In column 3, line 8, insert --in--between "shown" and "cross-section".

In column 3, line 10, delete "in stalled" and replace therewith --installed--.

In column 8, line 55, delete "nonpainer" and replace therewith --nonplanar--
In column 8, line 65, insert --, --, after "retainer".

In column 11, line 32, delete "V-shape shaped" and replace therewith --V-shaped--.

Signed and Sealed this

First Day of May, 2007

JON W. DUDAS
*Director of the United States Patent and Trademark Office*